United States Patent [19]

Viesturs et al.

[11] 4,353,232

[45] Oct. 12, 1982

[54] APPARATUS FOR MAKING CORRUGATED TUBING AND METHOD FOR JOINING CORRUGATED TUBING

[75] Inventors: Elmars H. Viesturs; Billy J. Bauscher, both of Rockford, Ill.

[73] Assignee: The Lockformer Company, Lisle, Ill.

[21] Appl. No.: 116,141

[22] Filed: Jan. 28, 1980

[51] Int. Cl.[3] ..... B21C 37/12; B21D 11/06

[52] U.S. Cl. ..... 72/50; 72/135

[58] Field of Search ..... 72/50, 49, 135, 137, 72/181, 419, 428; 228/145, 146, 147, 17.5, 17.7, 17; 242/75.42, 75.43

[56] References Cited

U.S. PATENT DOCUMENTS

| | | | |
|---|---|---|---|
| 19,963 | 4/1858 | Bailey | 72/197 |
| 847,977 | 3/1907 | Ballard | 242/75.43 |
| 1,580,760 | 4/1926 | Palmer . | |
| 1,739,774 | 12/1929 | Thorsby . | |
| 2,282,176 | 5/1942 | Fay | 72/50 |
| 2,344,274 | 3/1944 | Stacom . | |
| 2,350,070 | 5/1944 | Shellmer . | |
| 2,693,779 | 11/1954 | Padgett . | |
| 2,772,646 | 12/1956 | Padgett . | |
| 3,069,107 | 12/1962 | Hirt | 242/75.43 |
| 3,070,054 | 12/1962 | Grieten . | |
| 3,106,177 | 10/1963 | Nicolaisen . | |
| 3,220,234 | 11/1965 | Harper | 72/50 |
| 3,247,692 | 4/1966 | Davis | 72/49 |
| 3,269,162 | 8/1966 | Fay | 72/145 |
| 3,306,091 | 2/1967 | Bursk | 72/240 |
| 3,309,909 | 3/1967 | Wilson | 72/237 |
| 3,388,578 | 6/1968 | Wykes | 72/240 |
| 3,417,587 | 12/1968 | Campbell | 72/50 |
| 3,457,749 | 7/1969 | Smola . | |
| 3,538,728 | 11/1970 | Trihey | 72/23 |
| 3,595,046 | 7/1971 | Kalervo | 72/49 |
| 3,604,464 | 9/1971 | Pelley | 72/49 |
| 3,707,170 | 12/1972 | Mazuir | 72/49 |
| 3,982,414 | 9/1976 | Anderson | 72/50 |
| 4,081,981 | 4/1978 | Lipp | 72/49 |
| 4,096,720 | 6/1978 | Anderson | 72/50 |

FOREIGN PATENT DOCUMENTS

| | | | |
|---|---|---|---|
| 1434985 | 5/1976 | United Kingdom | 242/75.43 |

*Primary Examiner*—Gene Crosby

*Attorney, Agent, or Firm*—McDougall, Hersh & Scott

[57] ABSTRACT

This apparatus contains a plurality of die-forming roller pairs which form corrugations longitudinally in ductile strip material. The die-forming rollers are gear driven from an electric motor of adjustable speed. One die roller of each pair has an eccentric mounting to provide adjustment of the space between roller pairs. The side edges of the strip material are formed into an inside and an outside seam element. A pair of rotatably mounted curling rollers provides the corrugated strip material with the proper radius of curvature and helical angle for convolution into corrugated tubing. An adjustment means is provided which simultaneously sets the proper position both pivotally and laterally of said curling roller pair according to tubing diameter selected. Radially adjustable guide rollers guide the circumference of the strip during convolution. A pair of support rollers and a run-out table support the tubing as it is produced. A means for loading is provided to enable one to easily load spools of strip material. Lengths of tubing may be joined by reducing one's end diameter by rotation and inserting it into another section. After insertion the reduced diameter is rotated to expand back near its original dimension, thereby locking the two lengths together. A seam which allows adjacent strips to rotate with respect to each other permits the change in diameter.

16 Claims, 29 Drawing Figures

129
128a
126a
126
128
133
127
127a
128b
131
132
131a
132a
130
135a
135b
135c 87
88
89
90
91
92
40
84c 85
20
86
84e

AXIS OF
COILING HEAD
ROTATION 44
105
116b
116a
95a
98a
16
11
104
111
98b
13
99
115
94
45
116c
96
95b
100
101a
114
101
102
103
119
120
121

FIG. 18
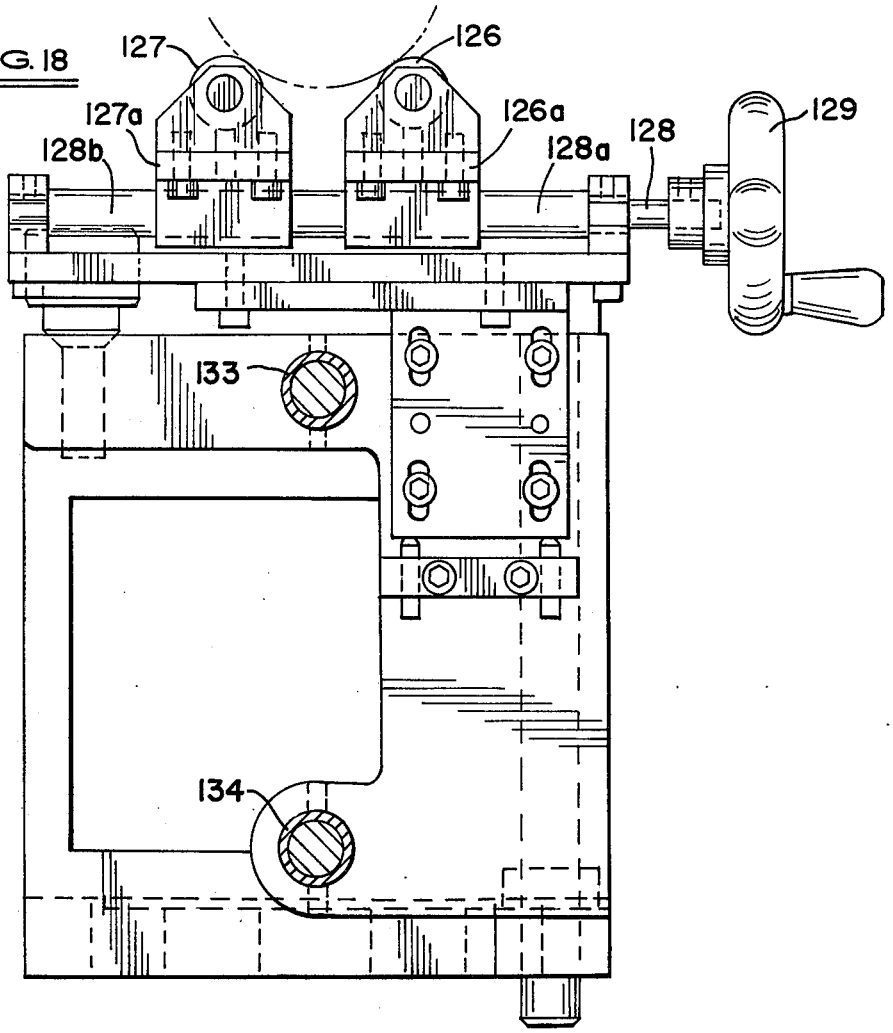
FIG. 21
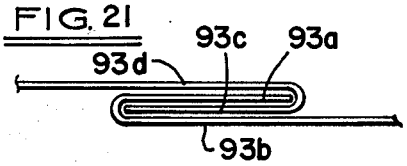
FIG. 22
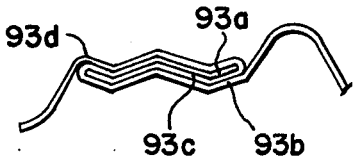
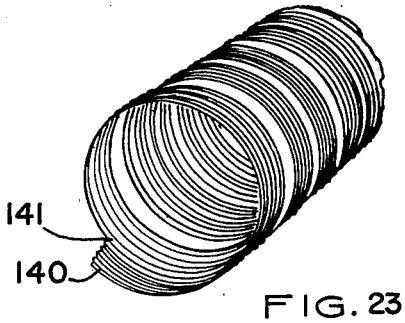
FIG. 23

APPARATUS FOR MAKING CORRUGATED TUBING AND METHOD FOR JOINING CORRUGATED TUBING

BACKGROUND OF THE INVENTION

This invention relates to the manufacture of corrugated tubing from strips of ductile material such as light gauge aluminum. The machine for making such tubing disclosed herein is characterized by an adjustment which simultaneously sets the proper radius of curvature and helical angle needed to manufacture varying diameter sizes of tubing without requiring either the substitution or addition of parts.

There is a recognized need for flexible corrugated tubing especially constructed of light gauge aluminum in the heating, cooling and pressurized air fields. Such tubing is strong, resilient, and capable of being bent around a sharp radius.

Although there has been advancement in the machines utilized to manufacture corrugated tubing, the apparatus described herein represents significant improvements over existing manufacturing machines. The manufacturing apparatus disclosed in U.S. Pat. No. 4,096,720 is representative of machines currently utilized to manufacture corrugated tubing. This machine requires the substitution of parts in order to produce tubing of various diameters. When parts must be interchanged, the possibility exists for damaging the additional parts or even losing them. The instant invention overcomes these problems since no substitution or additional parts are required in order to produce different sized diameter tubing. Easier and faster changes from one size tubing diameter to another is accomplished by the current invention.

Another problem encountered in manufacturing tubing is the loading or mounting of the spool of ductile strip material from which the tubing is to be fabricated. Even if light gauge aluminum material is utilized, spools may weigh in excess of 100 pounds. It is difficult and sometimes impossible for a single man to lift such a spool in order to mount it in position for feeding the manufacturing machine. The instant invention overcomes this problem by incorporating a loading ramp and lifting mechanism which enables a single man to easily load and mount a spool of material.

Additional space is required for manufacturing tubing when the spool of strip material is mounted external to the manufacturing machine. External mounting also increases the likelihood that the thin guage strip material will be deformed or damaged before utilization. The instant invention overcomes these and related problems by enclosing the spool of material within the housing of the manufacturing machine itself.

Coupling two lengths of tubing together has presented difficulties. The instant invention produces tubing having a seam which permits adjacent strips to rotate with respect to each other. This permits the end of a length of tubing to be rotated either clockwise or counterclockwise thereby increasing or decreasing the diameter of the tubing at the end. Another length of tubing has its end rotated in the opposite direction. Thus, one length has an increased end diameter and the other has a decreased end diameter allowing insertion of the smaller diameter end into the larger. After insertion, the smaller is rotated to increase its diameter to near its original dimension and the larger is rotated to decrease its diameter to near its original dimension, thereby locking the two lengths together. This eliminates the requirement of special couplers, special machines, or complicated techniques to join lengths of tubing.

The instant invention provides a novel and improved apparatus for manufacturing corrugated tubing made of ductile strip material, such as light gauge aluminum and a method of joining corrugated tubing.

SUMMARY OF THE INVENTION

The instant apparatus makes corrugated tubing of selectable diameter without the substitution or addition of parts. A loading ramp and lifting assembly provide a means enabling a single man to easily load a heavy spool of strip material for manufacture.

The strip material is corrugated longitudinally by a plurality of pairs of die-forming rollers gear driven by an electric motor. The side edges of the strip are formed into inside and outside seam elements which are engaged after one convolution. The proper radius of curvature and helical angle for the desired diameter of tubing is imparted to the corrugated strip by a pair of adjustable curling rollers. The curling rollers are adjustable laterally to set the proper radius of curvature and angularly to set the proper helical angle. A means is provided for simultaneously adjusting the lateral and angular position of the curling rollers.

Three radially adjustable guide rollers guide the corrugated strip material during convolution. The inside seam element and outside seam element mate upon convolution to form an engagement which is locked to form a seam by squeezing and deforming said engagement between outside locking portions of said curling rollers. The formed tubing is supported by a pair of supporting rollers as it leaves the coiling head area. Formed tubing is supported subsequent to the support rollers by a run-out table which is pivotably mounted to the frame of said machine allowing it to be swung parallel and adjacent to said machine when not in use.

The machine is mounted on wheels for ease of movement. One of said wheels pivots to allow the frame to rest on the floor for stability during manufacture and pivots the frame above the floor when movement is desired.

It is a general object of the instant invention to provide a novel and improved apparatus for manufacturing corrugated tubing of selectable diameter from ductile strip material, such as light gauge aluminum.

Another object is to provide a novel method of joining corrugated tubing.

Other objects and features of the instant invention include:

(a) an improved means for loading spools of ductile material enabling a single man to mount a spool in position for manufacture;

(b) one die-forming roller of each pair has an eccentric mounting allowing the distance between rollers to be adjusted by rotation of the eccentric mounting.

(c) a single adjustable pair of rollers controls both the radius of curvature and helical angle;

(d) an adjustment means simultaneously sets the proper radius of curvature and helical angle by positioning of the curling roller pair, eliminating the need to substitute parts in order to manufacture different diameter tubing;

(e) the locked seam construction utilized provides added longitudinal strength as well as withstanding considerable angular torque;

(f) the locked seam allows rotational movement of the inside seam element with respect to the outside seam element to facilitate connection of one length of tubing with another;

(g) a simple pair of mating rollers serves to deform the seam between the inside and the outside seam elements by making corrugations along said seam, thereby creating a simplified locking seam;

(h) radially adjustable guide rollers guide the stripping during convolution insuring uniform diameter;

(i) a pair of adjustable support rollers support the manufactured tubing after formation to prevent unnecessary torque;

(j) a run-out table supports the length of tubing during manufacture to reduce torque and to provide a surface upon which the tubing can be cut to the desired length;

(k) a frame is mounted on wheels for ease in movement, one of the wheels is pivotally attached allowing the frame adjacent to that wheel to rest on the floor for stability during manufacture, or to pivot the frame above the floor for rolling movement when desired.

BRIEF DESCRIPTION OF THE DRAWINGS

FIG. 18 is a side view of the support roller mechanism taken about line 18—18 in FIG. 17.

FIG. 21 is a fragmentary edge view generally illustrating the mating between the inside seam element and outside seam element.

FIG. 22 is a fragmentary edge view of the seam after locking illustrating the engagement between the inside and outside seam element.

FIG. 23 is a perspective view of formed corrugated tubing.

DESCRIPTION OF THE PREFERRED EMBODIMENT

The following detailed description in conjunction with the referenced drawings is made so that a person skilled in this art can readily apprehend the instant invention.

Figure 1:
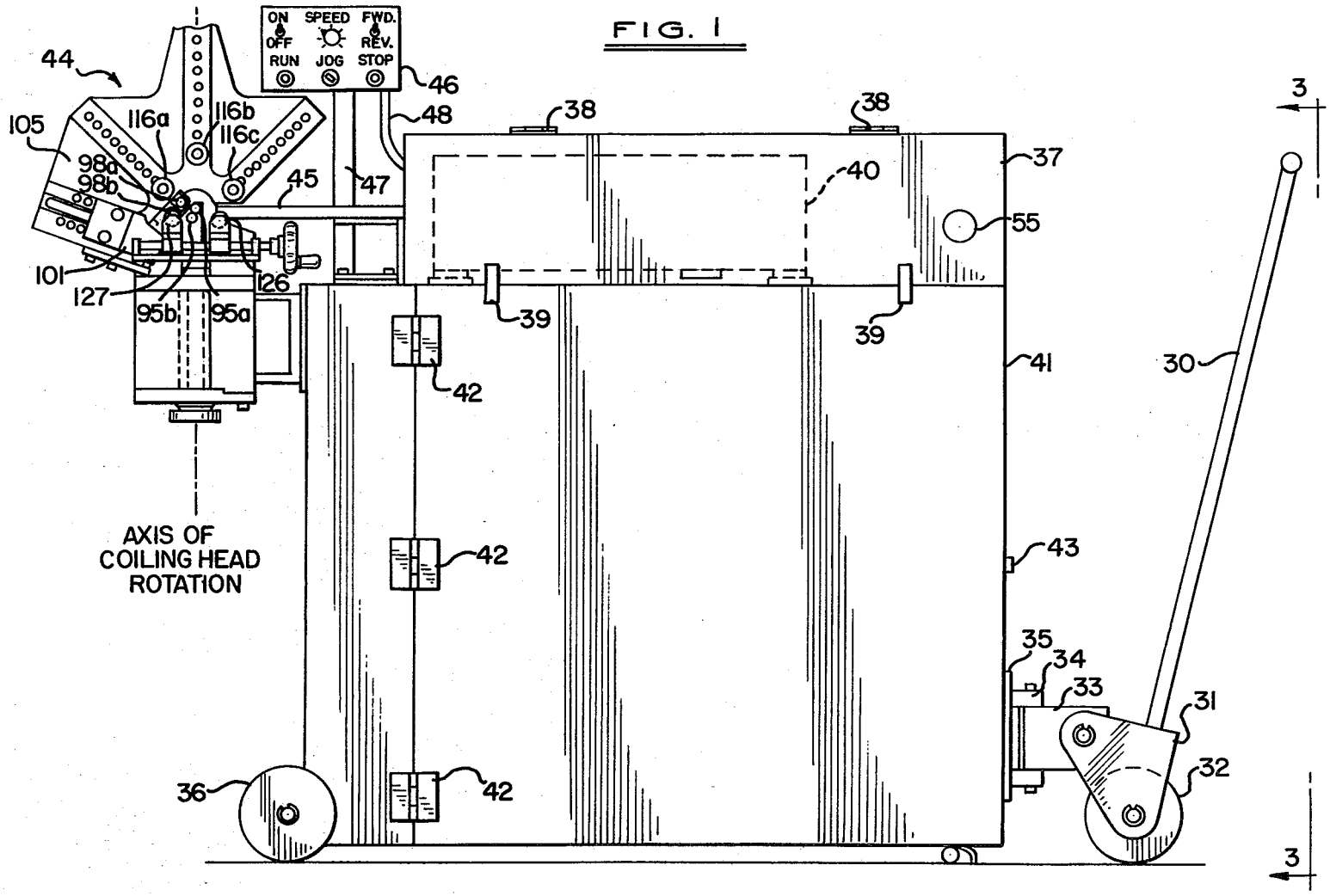
FIG. 1 is a side view of the apparatus with the run-out table not shown for clarity.

FIG. 1 illustrates the instant invention as having a handle 30 mounted to pivoting bracket 31 to which rotatable wheel 32 is mounted. Bracket 31 is mounted to a tongue 33 which is in turn mounted by hinge 34 to frame 35 so as to allow bracket 31 to pivot horizontally as well as vertically. Two rear wheels 36 are mounted to the frame thereby permitting the apparatus to be easily moved.

Upper enclosure cover 37 is mounted by hinges 38 to allow easy access to the interior while clips 39 serve to hold cover 37 in place. Vertical plate 40 carries a plurality of gear driven die-forming rollers to be described hereinafter. Lower enclosed cover 41 has hinges 42 attached to provide easy access to the interior with clip 43 holding cover 41 in place.

Coiling head 44 is pivotally mounted to frame 35 for horizontal rotation about the axis shown in FIG. 1. Stripping which has been previously corrugated by said die-forming rollers moves from right to left inside rectangular guide 45. This stripping is convoluted in a clockwise direction within the coiling head. A further detailed explanation of the convoluting and coiling process is described hereinafter with reference to other drawings.

The apparatus illustrated is designed to fabricate corrugated tubing using 3003-0 aluminum alloy strip wound in 30 inch diameter spools and having a gauge thickness of 0.007 inches. The aluminum stripping is prelubricated thereby eliminating the need to add oil or water to the stripping prior to die forming. The instant apparatus can produce corrugated ducting of selectable diameter over the range of 3 inch through 12 inch diameter ducting in one inch increments.

Control box 46 is mounted to the frame by a support element 47. Cable 48 containing a plurality of wires makes the required connections with the control box.

The control box has two horizontal rows of different controls. The upper row (from left to right) contains master on/off switch, a continuously variable speed control, and a switch controling the direction of strip movement, either in a forward or reverse direction, with forward being from right to left. The bottom row of controls contains two push buttons corresponding to run and stop controls with the center control being a jog switch. During normal production operation, once the run push button is depressed the machine will operate until the stop button is pushed. However, if more control is desired the jog switch is activated thereby causing the machine to operate only while the run button is depressed.

Figure 2:
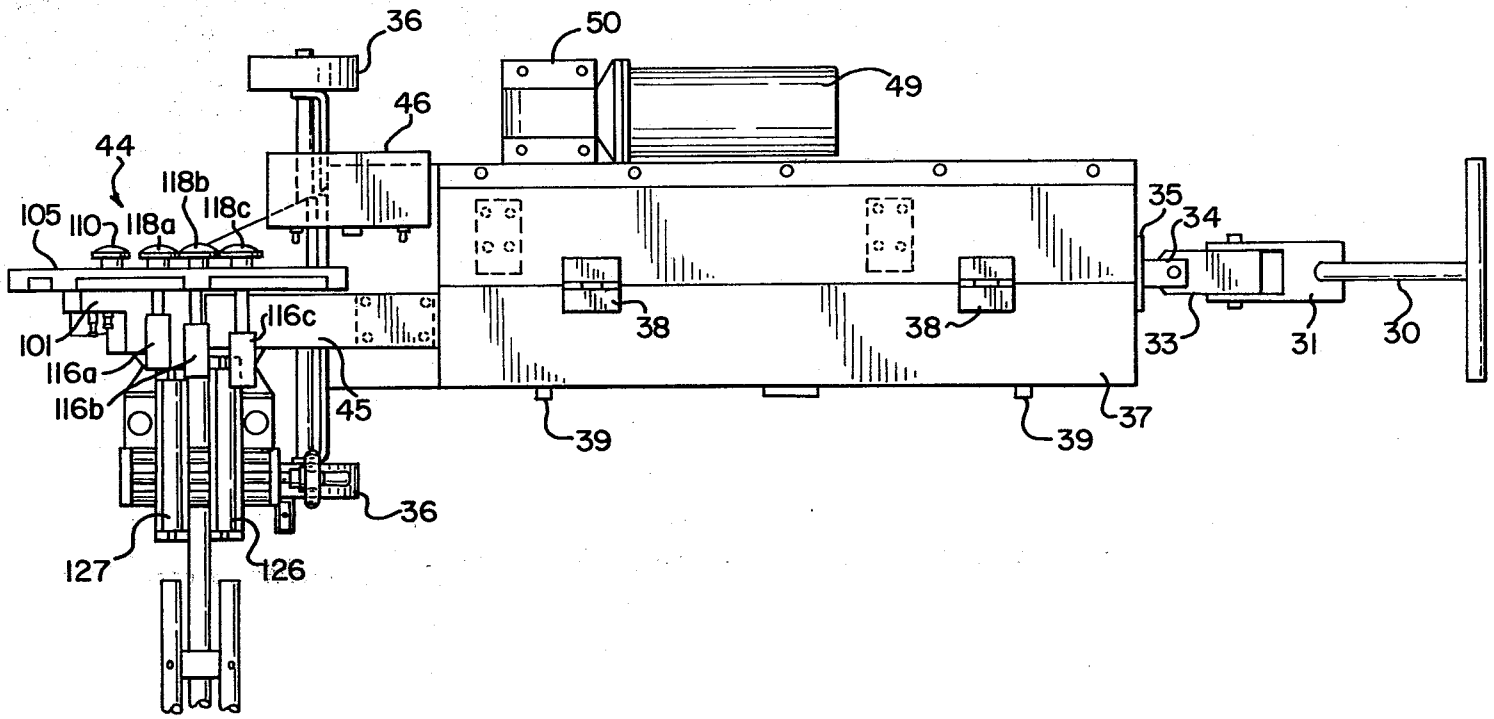
FIG. 2 is a top view of the apparatus with only the beginning portion of the run-out table shown.
Figure 3:
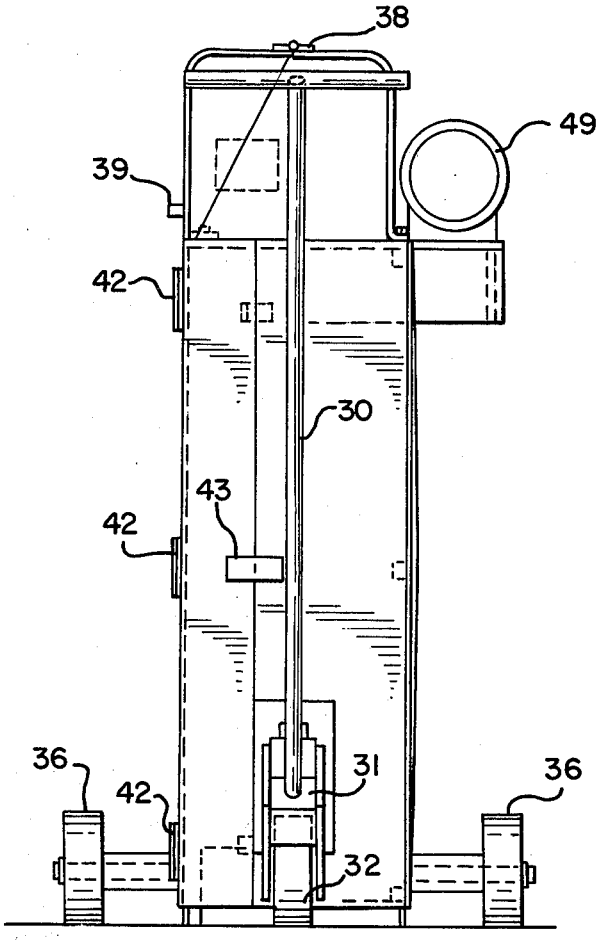
FIG. 3 is an end view of the apparatus as taken at a line 3—3 of FIG. 1.
Figure 7:
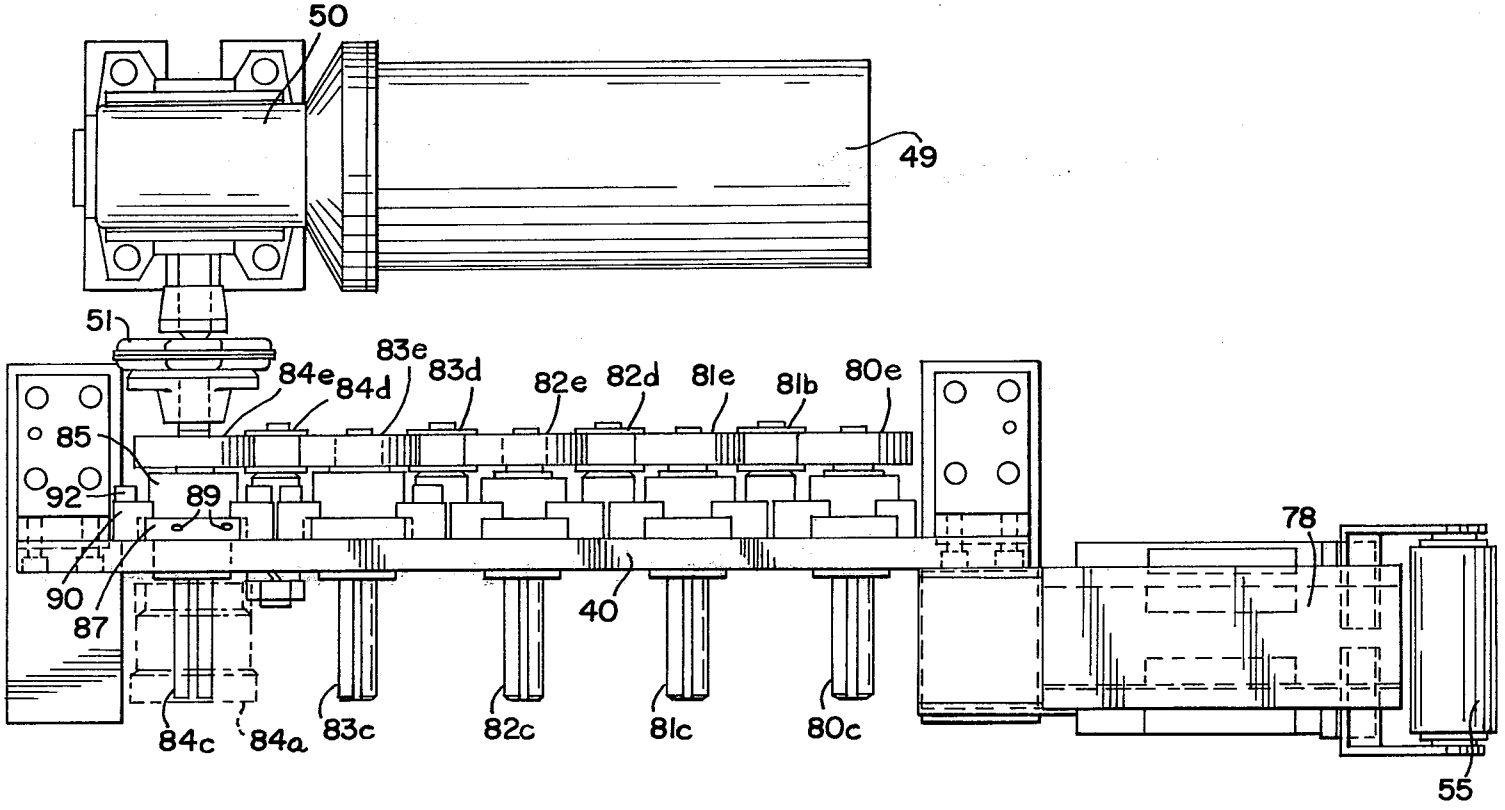
FIG. 7 is a fragmentary top view of the apparatus omitting the coiling head assembly.

FIGS. 2, 3 and 7 illustrate electric motor 49 driving gear reduction box 50 which in turn utilizes flexible shaft coupling 51 to transmit power to the die rollers. A D.C. motor 49 used in this machine operates from rectified 115 VAC, single phase, and whose speed is controlled by a potentiometer controlled by variable speed control adjustment located on control box 46.

Figure 4:
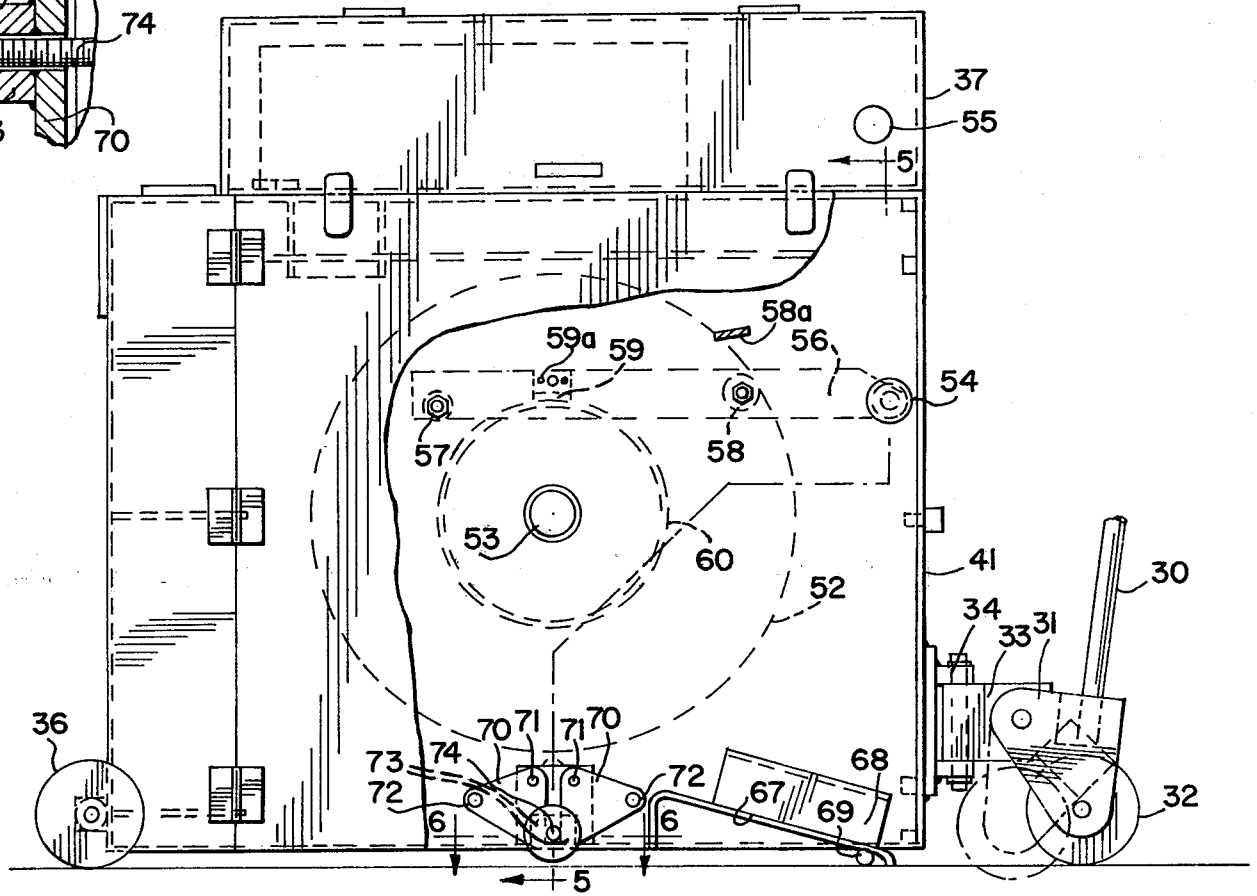
FIG. 4 is a side view of the apparatus with the coiling head assembly omitted illustrating both the stationary and rolling positions of the pivoting wheel, and the loading means.

Now referring to FIG. 4, a spool of light gauge strip aluminum 52 is mounted to rotatable hub assembly 53. Spool 52 turns in a clockwise direction as the strip aluminum is unrolled during manufacture. A strip of aluminum leaves contact with spool 52 at the upper right-hand portion of its circumference and travels underneath and around the right side portion of idler roller 54 and continues around the right hand and top surface of idler roller 55. The force used to unroll the strip aluminum along the aforesaid path is provided by the power driven die roller pairs.

Figure 5:
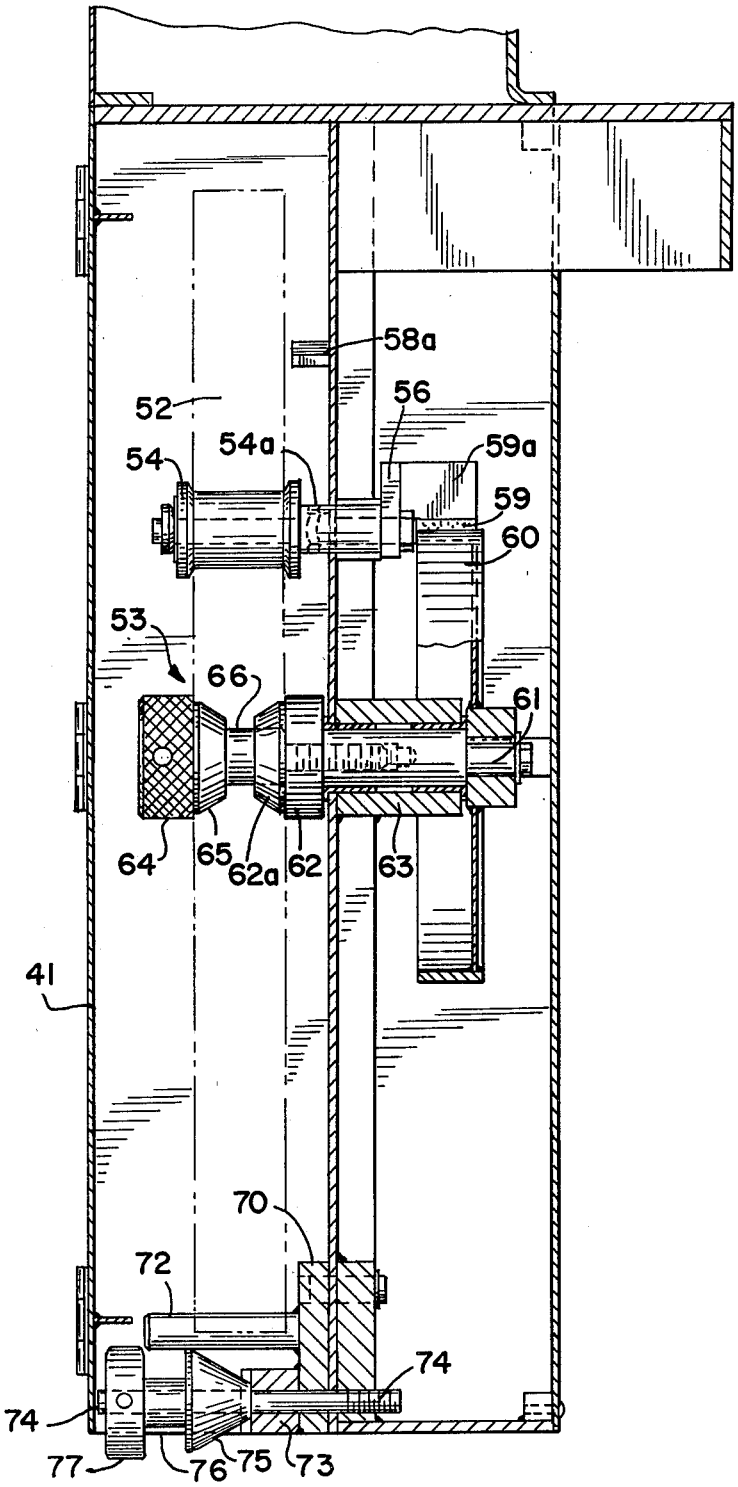
FIG. 5 is a fragmentary cross sectional end view of the apparatus taken about line 5—5 in FIG. 4.

The braking mechanism utilized to stop the rotation of spool 52 after manufacture has stopped is best illustrated by referring to FIGS. 4 and 5. Braking arm 56 is pivotally mounted by bolt 57 to the frame and carries rotatable idler roller 54 by means of shaft 54*a*. The pivoting action of braking arm 56 is limited by resilient roller 58 contacting stop bracket 58*a*. A contoured asbestos braking pad is mounted to a bracket 59*a* which is mounted to the braking arm. Braking pad 59 is illustrated in FIG. 5 as making contact with braking disc 60 which is mounted by means of shaft portion 61 of the rotatable hub.

During operation there is sufficient tension placed on idler roller 54 by the aluminum strip to cause the idler wheel and connected braking arm 56 to be pivoted upward such that brake pad 59 does not ride on braking disc 60. Thus, during operation the brake pad 59 is rotated away and does not make contact with braking disc 60. At the termination or suspension of manufacture, the tension created on the stripping is released whereby the weight of the braking arm 56 causes roller 54 to descend to the position illustrated in FIGS. 4 and 5. The descending of the braking arm 56 causes braking action to be applied to spool 52 by means of brake pad 59 and braking disc 60.

Hub assembly 53 is best illustrated by referring to FIG. 5. An inside collar 62 having a tapered portion 62*a* is free to rotate within mounting 63. An outside collar comprises a a knurled knob 64, a tapered section 65, and a reduced diameter shaft 66 having a threaded stud which is threadedly connected to inside collar 62. A spool of strip material is inserted by completely removing the outside collar and positioning the core of the spool about the tapered portions 62 of the inside collar. The outside collar then is inserted through the core to make threaded contact with the inside collar. The outside collar is then rotated thereby drawing the outside collar tapered portion 65 into firm contact with the core, thereby locking the spool on to the hub assembly 53.

Figure 6:
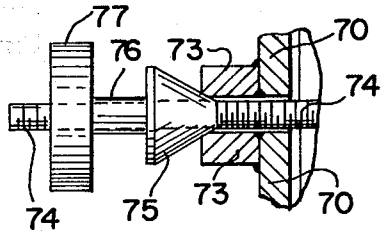
FIG. 6 is a fragmentary cross sectional view of part of the loading means taken about line 6—6 in FIG. 4.

A single man may mount a spool of aluminum weighing over 100 pounds on the hub assembly by utilizing a loading feature incorporated in the instant invention which is best illustrated by referring to FIGS. 4, 5 and 6. A spool is rolled up ramp 67 which has a support 69 and inside guide 68. The spool is then rolled from ramp 67 onto support pins 72 attached to lifting plates 70. Lifting plates 70 are hingedly attached at points 71 and carry pressure brackets 73. A threaded stud 74 projects from the frame between plates 70 adjacent pressure brackets 73. A cone 75 and collar 76 are mounted on stud 74 for lateral sliding movement along said stud. Knurled knob 77 is threadedly connected to stud 74. As knob 77 is screwed inwardly, cone 75 forces pressure bracket 73 to pivot away from stud 74 thereby causing support pins 72 to pivot upward thereby lifting the spool into position for mounting on the hub assembly. The spool is then mounted to the hub as previously described.

A better understanding of wheel 32 pivoted by movement of handle 30 may be ascertained by reference to FIG. 4. FIG. 4 illustrates a phantom view showing handle 30 having been moved to a more horizontal position thereby causing bracket 31 and wheel 32 to pivot downwardly. In the position as shown in the phantom view, the apparatus would be free to roll on rear wheels 36 and pivotal wheel 32. The solid line illustration of handle 30 and wheel 32 illustrates that adjacent frame portion of the apparatus is resting upon support 69 and ramp 67. In this position the apparatus is stabilized by contact made with the floor by ramp 67 and support 69.

Figure 8:
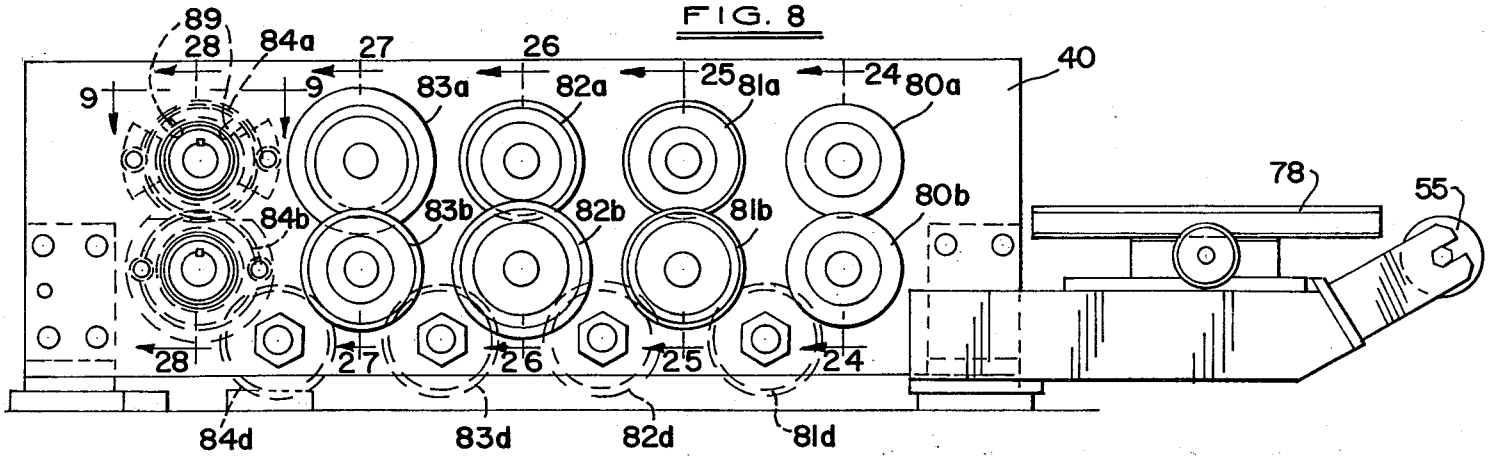
FIG. 8 is a partial side view portion of the upper portion of the apparatus including die-forming rollers and the guide apparatus for feeding strip material to said rollers.

The interior portion of the apparatus enclosed by cover 37 contains the die rollers which is best illustrated in FIGS. 7 and 8. In both FIGS. 7 and 8 the movement of strip material is from right to left. The strip material passes over roller 55 and through rectangular guide 78 which makes firm contact with the strip material thereby straightening minor fluctuations or deformities in the strip aluminum prior to entering the roller dies.

Five pairs of roller dies comprising upper dies 80*a* through 84*a* mate respectively with lower dies 80*b* through 84*b*. The function of the roller dies is to form longitudinal corrugations in the aluminum strip and to provide initial forming of the side edges of the strip so that inside and outside seam elements can be completed in a subsequent operation. Upper roller dies 80*a* through 84*a* mount respectively on rotatable keyed spindles 80*c* through 84*c*. The bottom row of roller dies are similarly mounted on keyed spindles not shown in FIG. 7.

The five pairs of die forming rollers are driven by electric motor 49. Electric motor 49 provides direct drive to the spindle carrying lower roller die 84*b*. A toothed gear wheel is mounted to said spindle below gear 84*e*. This gear wheel drives an idler gear 84*d* which in turn drives another tooth gear wheel attached to a shaft driving the spindle carrying die roller 83*b*. Similarly, 83*d*, 82*d* and 81*d* drive respectively die rollers 82*b*, 81*b* and 80*b*. Thus the lower row of die-forming rollers are gear driven in a daisy chain sequence. The gearing is such that each of the lower row of die-forming rollers is driven in a counter-clockwise direction with the same angular velocity.

The upper row of die-forming rollers are driven directly by the rotation of corresponding lower respective die rollers. The shaft end of spindle 84c has a toothed gear having the same dimensions as the gear associated with the spindle carrying lower die roller 84b. The gear associated with die roller 84b directly drives gear 84e thereby causing the upper die roller 84a to rotate in a clockwise direction with the same angular velocity as the lower die roller. Similarly, die rollers 83a, 82a, 81a and 80a are driven by gears 83e, 82e, 81e, and 80e from corresponding gears of die rollers 83b, 82b, 81b, and 80b. Idler gears 84d through 81d rotate about shafts mounted to vertical plate 40.

Figures 9, 19, 20:
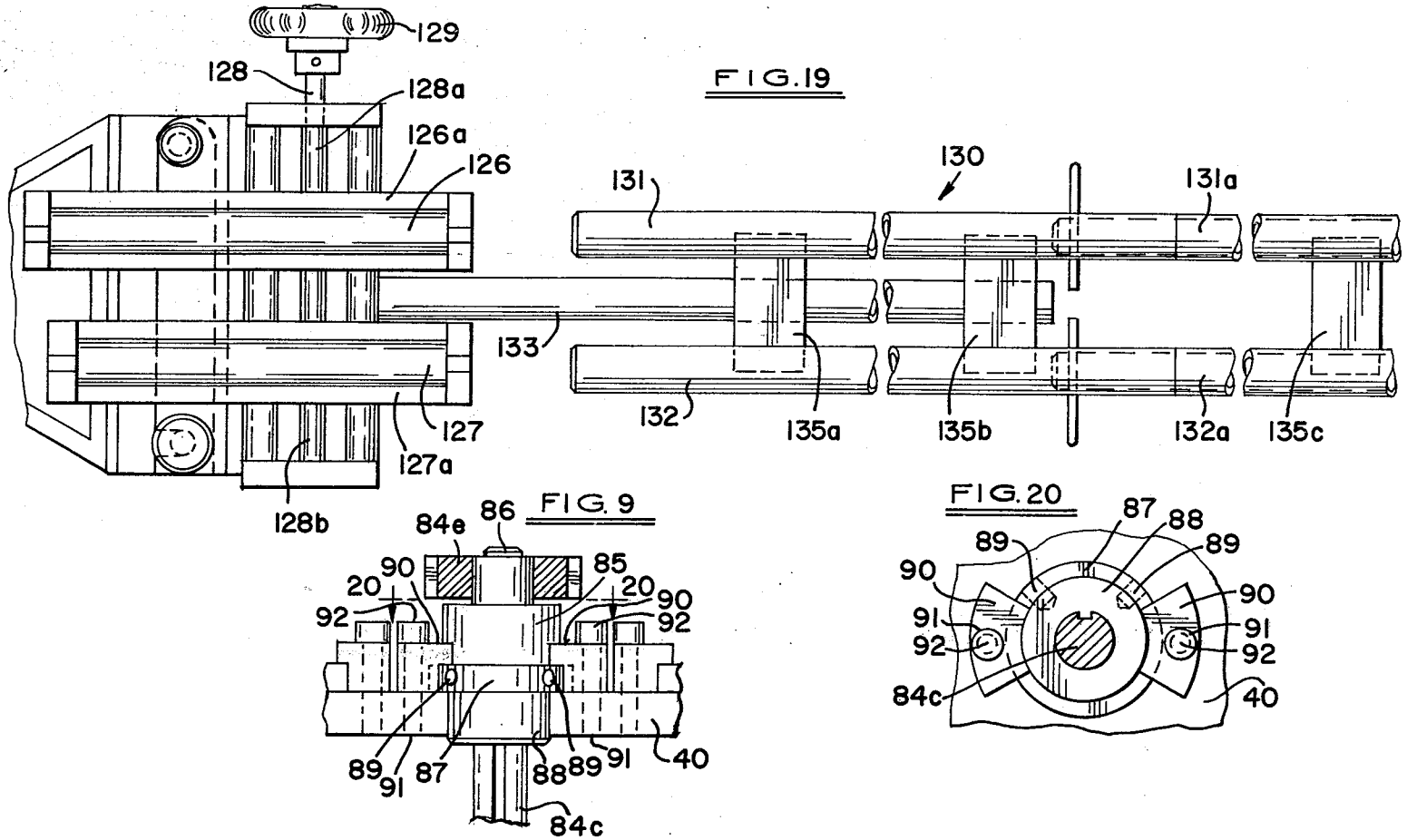
FIG. 9 is a top fragmentary view of an upper die-forming roller taken about line 9—9 in FIG. 8.
FIG. 19 is a top view of the run-out table and supporting rollers.
FIG. 20 is a side exploded view of the die roller pair shown in FIG. 8 about which section line 28 is taken.

Mounting the plurality of die-forming rollers to vertical plate 40 is best understood by referring to FIGS. 7, 9 and 20. The lower row of die-forming rollers are carried by spindles which have conventional bearing mountings affixed to vertical plate 40.

The upper row of die-forming rollers have corresponding spindles which are mounted off-center from the center line of each's associated mounting. This off-center allignment provides an eccentric which is utilized to adjust the position of the spindle and hence the position of the upper die roller with respect to the lower matching die roller.

FIG. 9 best illustrates the eccentric mounting of the upper die rollers spindles. Spindle 84c with corresponding shaft 86 are free to rotate on ball bearings contained by mounting 85. Mounting 85 has an expanded collar portion 87 followed by reduced diameter portion 88 which is mounted within a hole provided in plate 40. The axis of spindle 84c is 0.020 inches offset from the center line of mounting 85. Therefore, rotating mounting 85 will cause an arcuate movement in spindle 84c which is utilized to adjust the spacing between the upper die roller and the corresponding lower die roller. Two small holes 89 are drilled in collar section 87 of mounting 85 to facilitate grasping the mounting for adjusting the spacing between upper and lower die rolling pairs.

Once the proper adjustment is made, arcuate clamps 90 lock mounting 85 to vertical plage 40. Clamps 90 have a portion as can best be seen in FIG. 9 that overlap the expanded collar 87 of mounting 85. Threaded holes 91 in plate 40 receive screws 92 which lock clamps 90 and expanded collar portion 87 to vertical plate 40. This same mounting method is utilized to mount each of the top row of die-forming rollers thereby creating an eccentric adjustment allowing the spacing between upper and lower matching pairs of die rollers to be adjusted.

FIGS. 24 through 28 illustrate the longitudinal corrugation forming and side edge shaping accomplished by die roller pairs 80 through 84 respectively. These views show cross sections of matching die roller pairs with strip 93 being corrugated. The outside edge (outside seam element) corresponds to the left portion of strip 93; the inside edge is on the right side.

Figure 29:
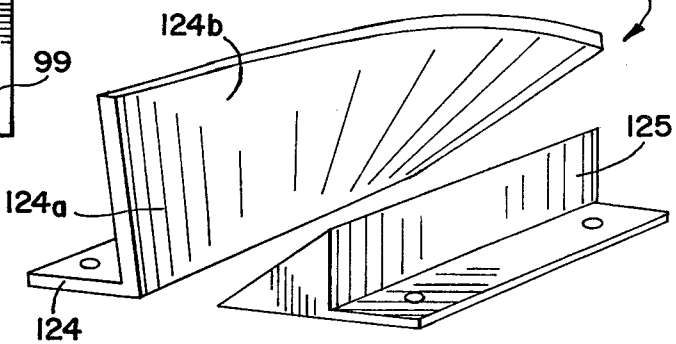
FIG. 29 is a perspective view of the die pair which provides further forming of the outside edge of the strip.
Figure 10:
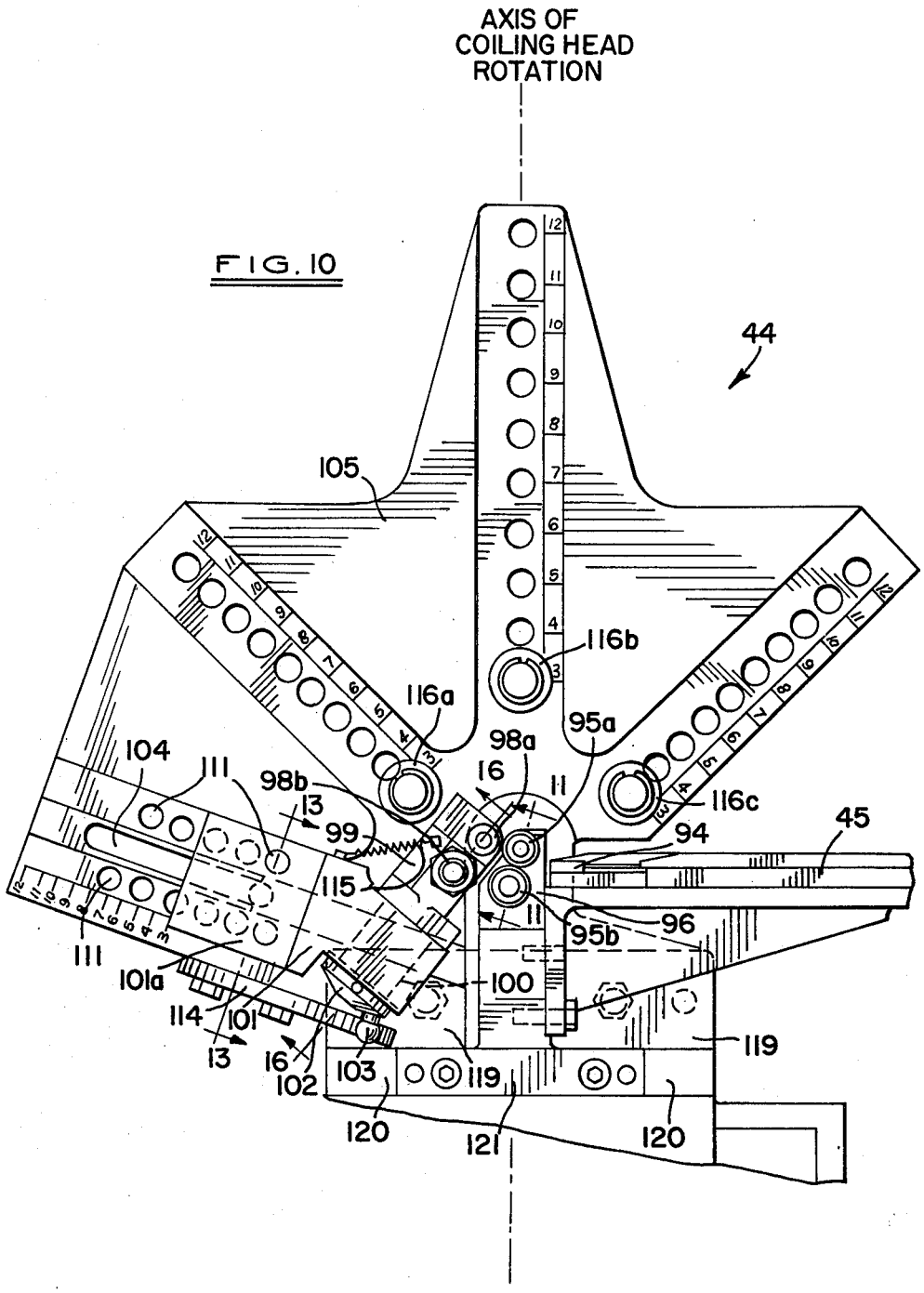
FIG. 10 is a side view of the coiling head with adjustable support roller assembly and run-out table omitted for clarity.

FIGS. 10 through 16 best illustrate coiling head 44 which convolutes the corrugated strip supplied by the die-forming roller pairs and locks a common seam to form corrugated tubing. FIG. 29 illustrates edge forming dies 94 as shown in FIG. 10 which serve to further form the outside side edge of the strip 93 and provides the initial engagement between the inside and outside seam elements. Further description and explanation of dies 94 and its operation is provided hereinafter.

Figure 11:
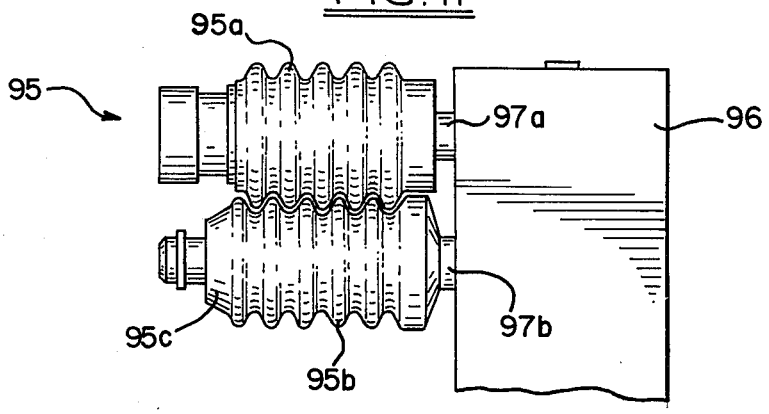
FIG. 11 is an expanded view of the stabilizing roller pair taken about line 11—11 in FIG. 10.

Now referring to FIG. 10, the location of the various components associated with the formation of tubing from the corrugated strip material is shown. Stabilizing roller pair 95 is comprised of an upper roller 95a and lower roller 95b. These two rollers are rotatably mounted to block 96 which is carried by the main frame 35. As seen in FIG. 11, rollers 95a and 95b are mounted for rotation respectively about shafts 97a and 97b to block 96. These two rollers are contoured to the existing corrugations in the aluminum stripping. The primary function of these two rollers is to stabilize the corrugated stripping at a position which will correspond to the bottom periphery of the tubing to be formed. Stabilizing rollers 95a and 95b are mounted with their axes of rotation parallel to the plane of the entering corrugated stripping. As seen in FIG. 10, roller 95b is not mounted vertically beneath roller 95a, but is offset by a small clockwise angle. This positioning serves to impart an initial clockwise ray of curvature to the corrugated stripping 93. As seen in FIG. 10, the corrugated stripping will pass from right to left through the stabilizing pair of rollers 95.

Figure 16:
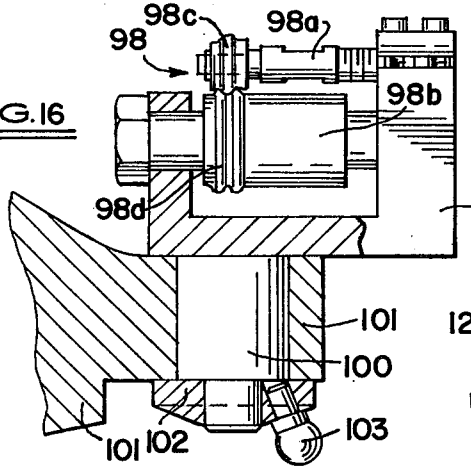
FIG. 16 is an expanded view of the curling roller pair taken about line 16—16 in FIG. 10.

Curling roller pair 98 comprising inside curling roller 98a and outside curling roller 98b are both rotatably mounted to bracket 99. As best illustrated in FIG. 16, bracket 99 has a shaft 100 which is carried by adjusting block 101 to allow rotation of bracket 99. A conical shaped collar 102 is immovably mounted to a reduced shaft portion of shaft 100. A spherical ball 103 is mounted to collar 102 and functions as a cam follower. Thus, arcuate movement of ball 103 translates into rotational movement of bracket 99 and curling roller pair 98.

Figure 13:
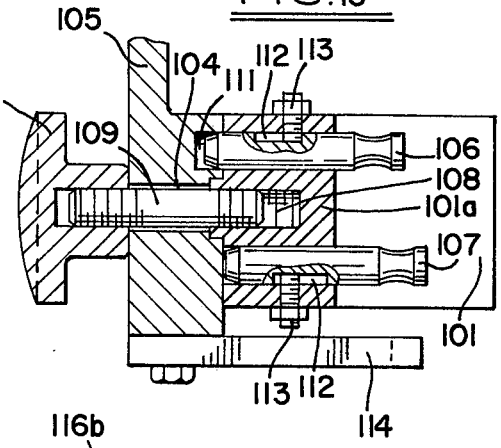
FIG. 13 is a fragmentary end view of the adjustable sliding block utilized in controlling the radius of curvature and helical angle taken about line 13—13 in FIG. 10.

Adjusting block 101 is mounted for sliding movement within the confines of a key slot 104 contained by coiling head plate 105. As seen in FIG. 13, sliding block 101 has a portion 101a containing locking pins 106 and 107, and a threaded hole 108. A shaft 109 threadedly engages threaded opening 108 and extends through key slot 104 where it engages knob 110. Two rows or holes 111 are offset with respect to each other such that only one of the locking pins will mate with a hole 111. As shown in FIG. 13, locking pin 106 is engaged in one of holes 111 while locking pin 107 is shown in the retracted position. Locking pins 106 and 107 have key ways 112 into which restraining screws 113 are inserted to prevent the locking pins from being completely withdrawn from sliding block 101.

As shown in FIG. 10, the end of portion 101a of sliding block 101 corresponds with index marking 3. A series of index markings labeled 3 through 12 appear on coiling head plate 105 parallel with key way 104. These index markings correspond with the diameter of tubing to be fabricated. One of locking pins 106 and 107 together with knob 110 lock the sliding block in place such that its end is alligned with the index marking corresponding with the size of the tubing to be fabricated. The offset used with holes 111 was necessitated because the small change needed to adjust the sliding block from one diameter to the next size would not permit a series of adjacent holes to be drilled because said series of holes would overlap into one another.

As illustrated in FIGS. 10 and 13, the sliding block is adjusted to produce 3 inch diameter tubing and is locked in place by knob 110 and locking pin 106. In this position, locking pin 107 would not correspond with one of holes 111. To adjust block 101 to fabricate 4 inch diameter tubing, key pin 106 would be retracted and knob 110 would be loosened to permit adjusting block 101 to slide outward along key slot 104 until its end aligned with index marking 4. At that point, locking pin 107 would align with a hole 111. Locking pin 107 would be pushed in a hole 111 and knob 110 would be tightened thereby locking the sliding block into position for fabricating 4 inch diameter tubing. Movement of block 101 causes curling rollers 98 to assume a new position as described hereinafter.

Plate 114 is shown in FIGS. 10 and 13 as being attached to coiling head plate 105 and extending perpendicular with respect to it. The width of plate 114 varies. The dotted line in FIG. 13 indicates that the width of plate 114 at its end closest to the axis of coiling head rotation is narrower than its opposite end. Ball 103 rides along right hand edge of plate 114 as viewed in FIG. 13. Abutting contact of ball 103 against plate 114 is assured by means of spring 115 which provides a torquing force to rotatable bracket 99 which is transmitted to ball 103. Thus, ball 103 acts as a cam follower with the edge of plate 114 which acts as a fixed cam defining a path of travel for ball 103. This camming action is utilized to pivot the curling roller pair 98 such that the curling roller pair imparts the proper helical angle to the corrugated tubing for the desired diameter of tubing being fabricated.

Curling roller pair 98 is also moved laterally by the movement of adjusting block 101. An imaginary plane containing the axis of rotation for curling roller 98*a* and 98*b* would form an angle with respect to the axis of curling head rotation. The curling roller pair is positioned in this manner so as to impart the correct radius of curvature to the corrugated strip. This lateral adjustment of the curling roller pair by adjusting block 101 positions the curling roller pair such that the correct radius of curvature is imparted to the corrugated stripping for the diameter of tubing being fabricated.

Therefore, setting portion 101*a* of adjusting block 101 to the index mark corresponding with the diameter of tube to be made, simultaneously adjusts curling rollers 98 to impart the proper radius of curvature and helical angle. These adjustments are self-contained. By "self-contained" it is meant that no substitution nor addition of parts are required to accomplish said adjustments.

Figure 12:
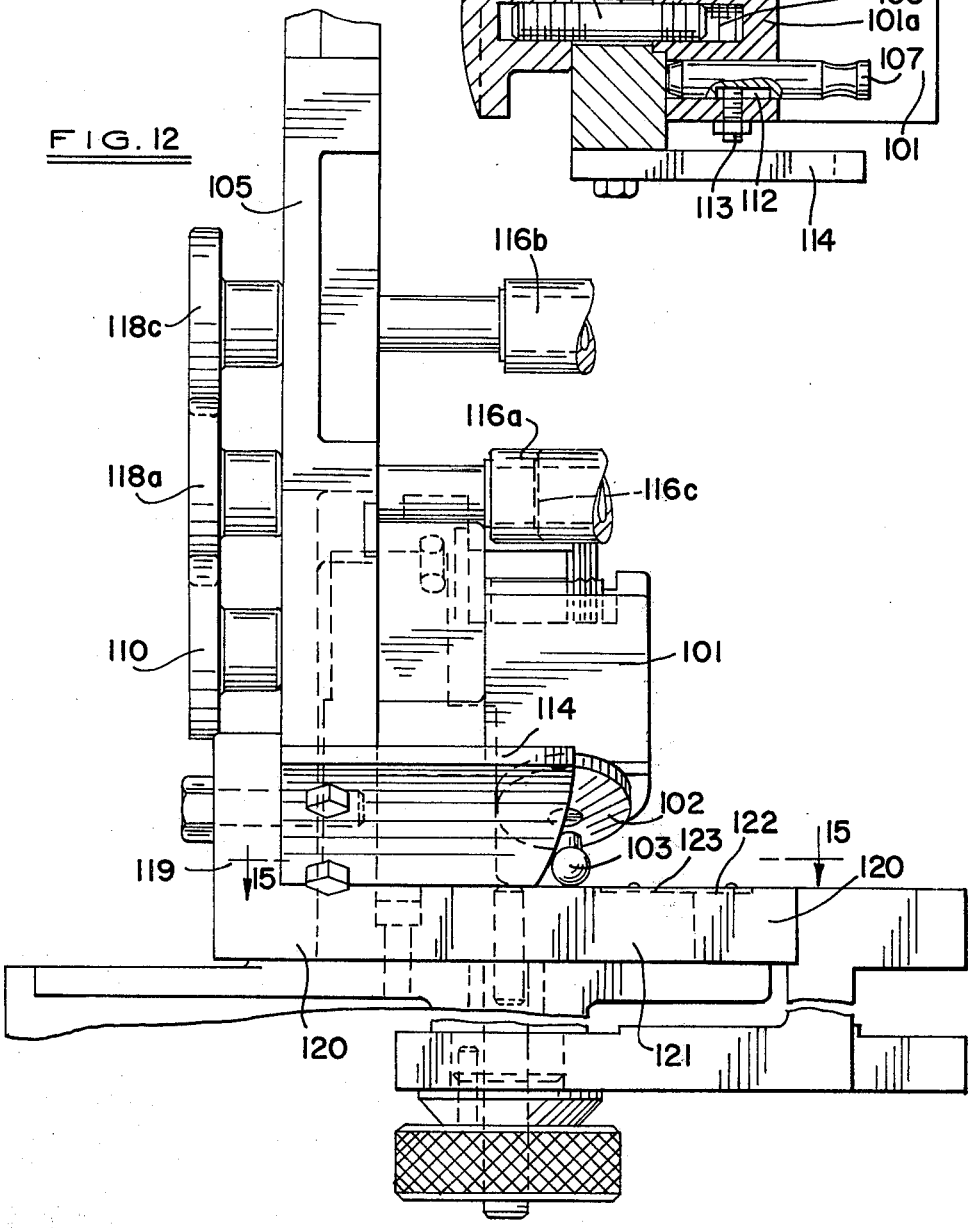
FIG. 12 is a fragmentary end view of the coiling head with the support roller mechanism and run-out table omitted.
Figures 14, 15:
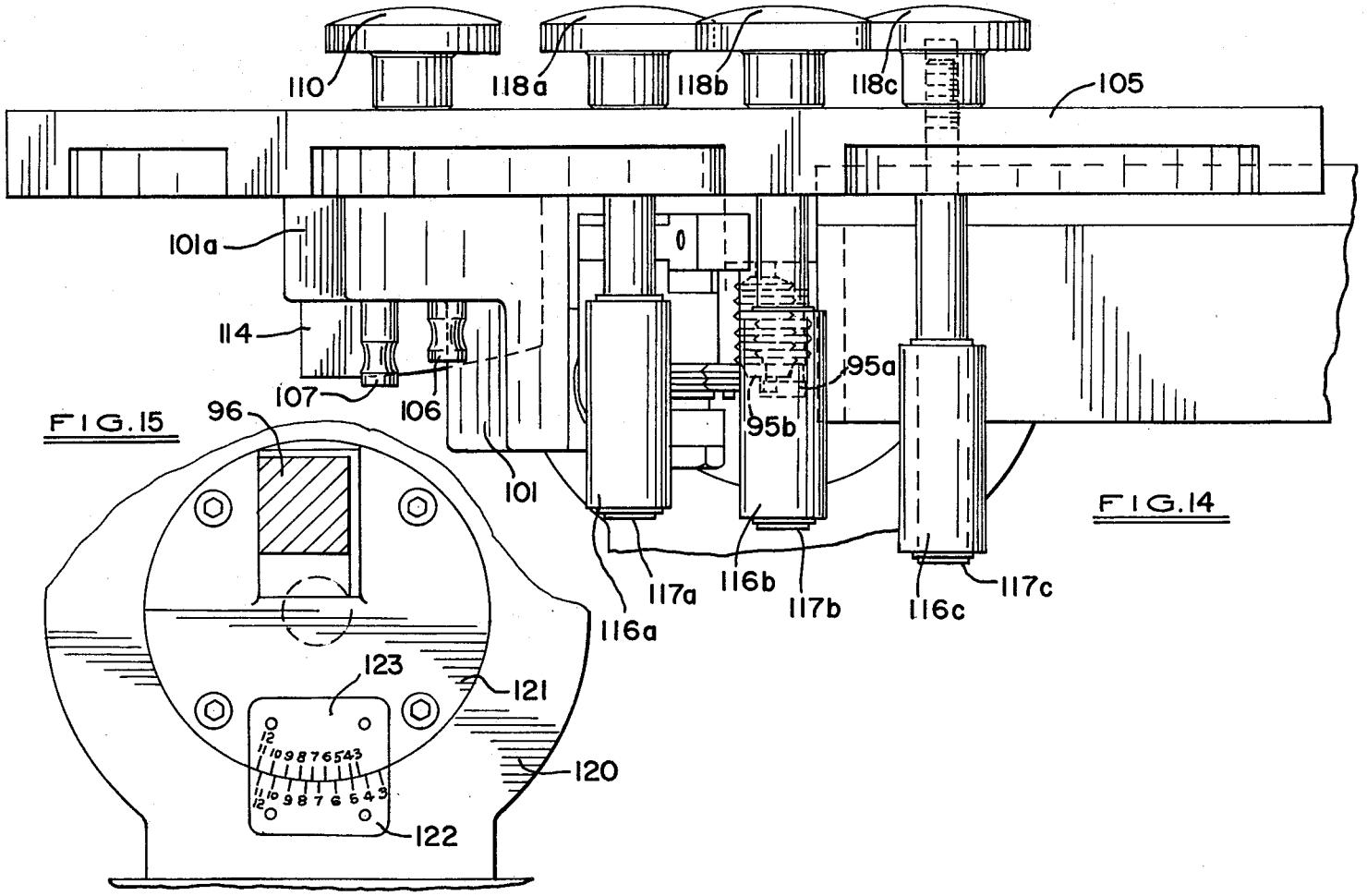
FIG. 14 is a top fragmentary view of the coiling head.
FIG. 15 is a view of the concentric rotating plates taken about line 15—15 in FIG. 12.

Now referring to FIGS. 10, 12 and 14, a set of guide rollers 116 guides the periphery of the corrugated strip as it is convoluted. Guide rollers 116 are comprised of rollers 116*a*, 116*b* and 116*c* which are rotatably mounted on shafts 117*a*, 117*b* and 117*c* respectively. Each of these three shafts have threaded end portions which mount through holes provided in the coiling head plate 105 and which are secured by knobs 118*a*, 118*b* and 118*c*. As illustrated in FIG. 14, guide rollers 116*a*, 116*b* and 116*c* are mounted progressively further away from coiling head plate 105. This progressive spacing is used since the corrugated strip is being spiraled or convoluted along a path taking it progressively further away from the coiling head plate. Thus, looking at FIG. 10, the corrugated tubing would be coming out of the plane of the drawing during manufacture. A series of parallel holes extend radially outward in coiling head plate 105 for each of the three guide rollers. Each of the holes are indexed with markings 3 through 12 which correspond to the proper setting of the guide rollers for diameter of tubing being made. FIG. 10 illustrates the guide rollers positioned properly for producing 3 inch diameter tubing.

The coiling head plate 105 (and therefore all components mounted on it) is free to rotate about the axis of coiling head rotation as indicated in FIG. 10. This axis of rotation bisects the center line of the corrugated tubing. Coiling head plate 105 is mounted to a horizontal plate 120 by means of a vertical extension 119 of said plate (See FIGS. 12 and 15). Plate 120 rotates concentrically about fixed plate 121 which is fixedly mounted to frame 35.

As shown in FIG. 15, plate 120 is rotatable about inner concentric plate 121. At the circumference of plate 121, rotatable plate 120 has index label 122 carrying indexing marks labeled 3 thru 12. Adjacent label 123 is carried by fixed plate 121. Markings on these two labels correspond to the diameter of the tubing to be made.

To adjust the coiling head plate for a given size diameter of tubing, rotatable plate 120 is rotated until index mark on label 122 corresponds with the same numerical index mark on label 123. This adjustment keeps coiling head plate 105 perpendicular to the axis of the manufactured tubing maintaining guide rollers 116 tangent to the outside circumference of the tubing.

FIG. 29 illustrates outside edge forming dies 94. Outside edge portions 93*a* and 93*b* of corrugated aluminum strip 93 passes between dies 124 and 125. The entrant face portion 124*a* of die 124 accepts portion 93*a* of the aluminum strip without deformation. Die 124 has a curved face 124*b* for folding section 93*a* of the aluminum stripping towards section 93*b*. As stripping portions 93*a* and 93*b* move between dies 124 and 125, section 93*a* is folded toward section 93*b* by the curvature of face 124*b*. Upon convolution, inside seam element (93*d* and 93*c*) is engaged with outside seam element (93*a* and 93*b*) prior to entering dies 94. Thus, dies 94 accomplish the initial forming of the seam. The purpose of die 125 is to provide support for section 93*b* so that section 93*b* retains its original slope. Dies 94 are mounted along the outside edge of rectangular guide 45 as shown in FIG. 10.

Figure 28:
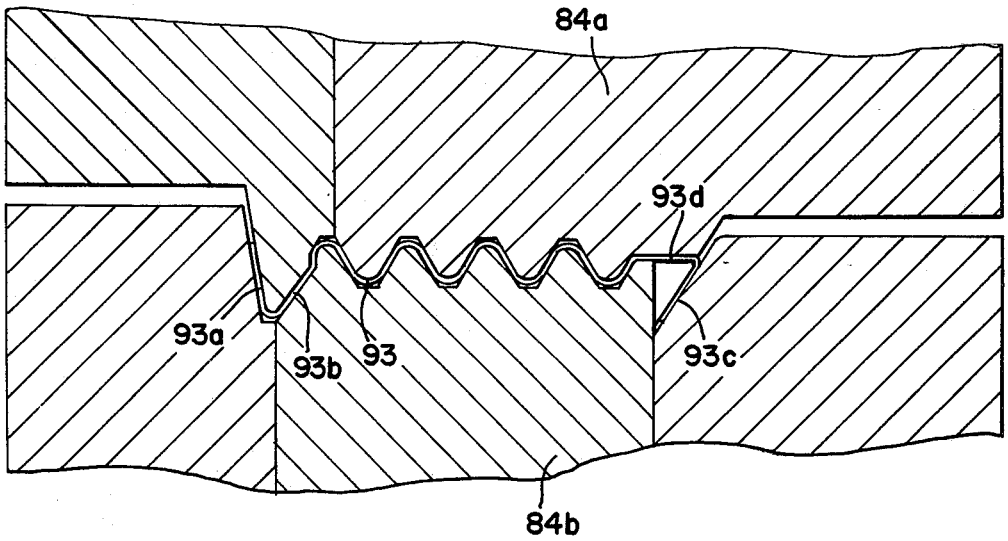
FIG. 28 is a fragmentary cross-sectional view of the fifth die roller pair taken about line 28—28 of FIG. 8.

A die (not shown) is mounted along the inside edge of rectangular guide 45 opposite dies 94. Portion 93*c* of the aluminum strip passes through a slit in this die having the same slope as section 93*c*. Thus, section 93*c* as shown in FIG. 28 exits this die with no change in shape. The function of this die is to merely provide support so that this portion 93*c* maintains its original shape upon entering the coiling head 44.

Support rollers 126 and 127 are best illustrated by referring to drawings 18 and 19. Support rollers 126 and 127 are free to rotate on carrying brackets 126*a* and 127*a* respectively. Brackets 126*a* and 127*a* are each threadedly mounted to threaded portions 128*a* and 128*b* of shaft 128. The threaded interface between shaft portion 128*a* and bracket 126*a* are by right-handed threading; bracket 127*a* mates with shaft portion 128*b*, which has left-handed threading. Thus, rotation of shaft 128 by handle 129 thereby causes support rollers 126 and 127 to either converge or diverge depending upon the rotation of the shaft 128. As shown in FIG. 18, support rollers 126 and 127 support the bottom circumference of the tubing as illustrated. The distance between these support rollers is variable so as to accommodate the diameter of tubing chosen to be manufactured.

Figure 17:
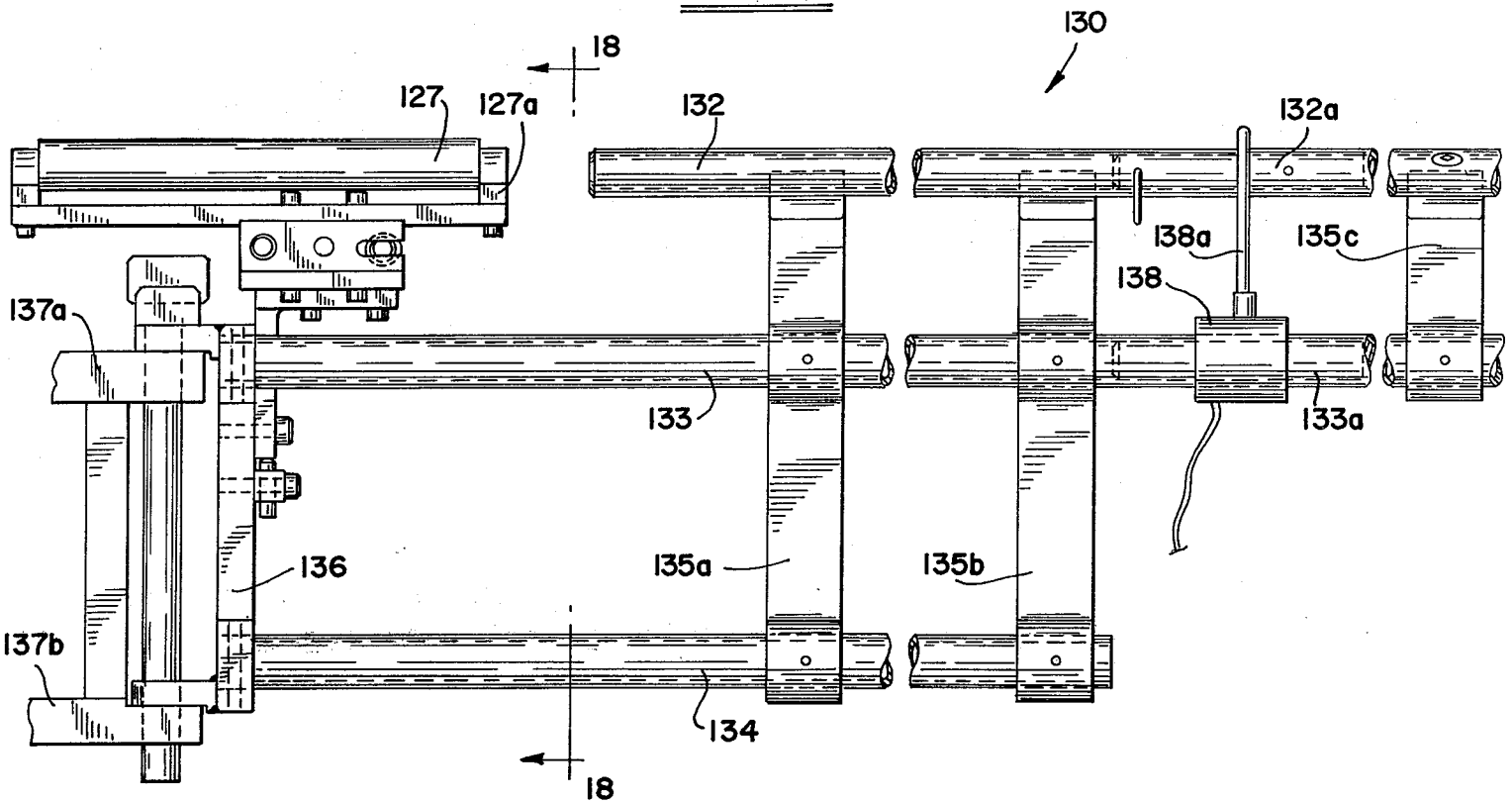
FIG. 17 is an end compressed view of the run-out table.
Figure 24:
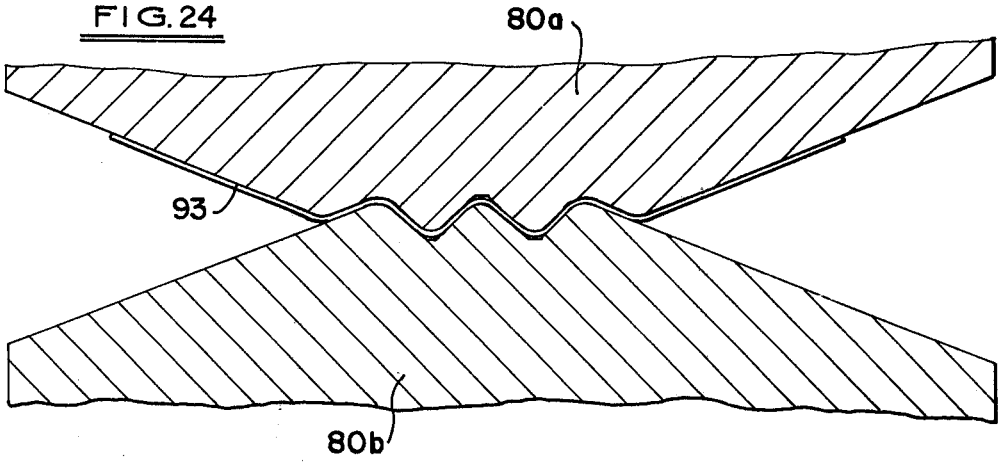
FIG. 24 is a fragmentary cross-sectional view of the first die roller pair taken about line 24—24 in FIG. 8.
Figure 25:
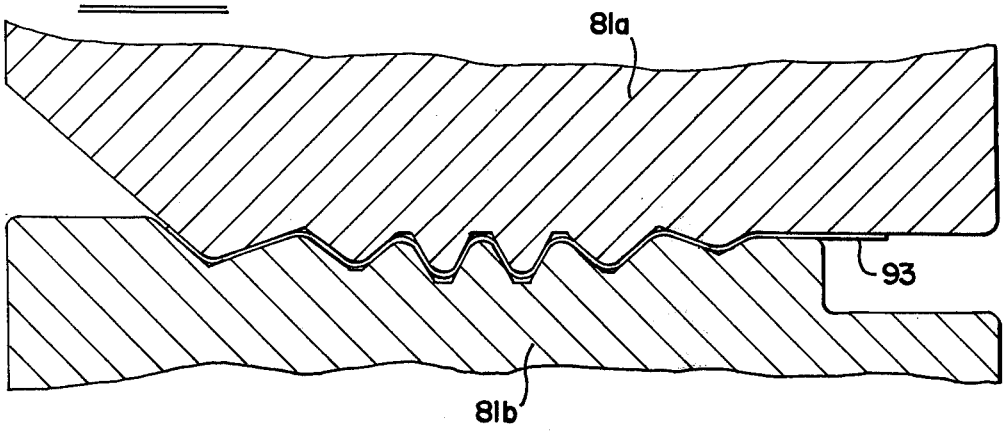
FIG. 25 is a fragmentary cross-sectional view of the second die roller pair taken about line 25—25 in FIG. 8.
Figure 26:
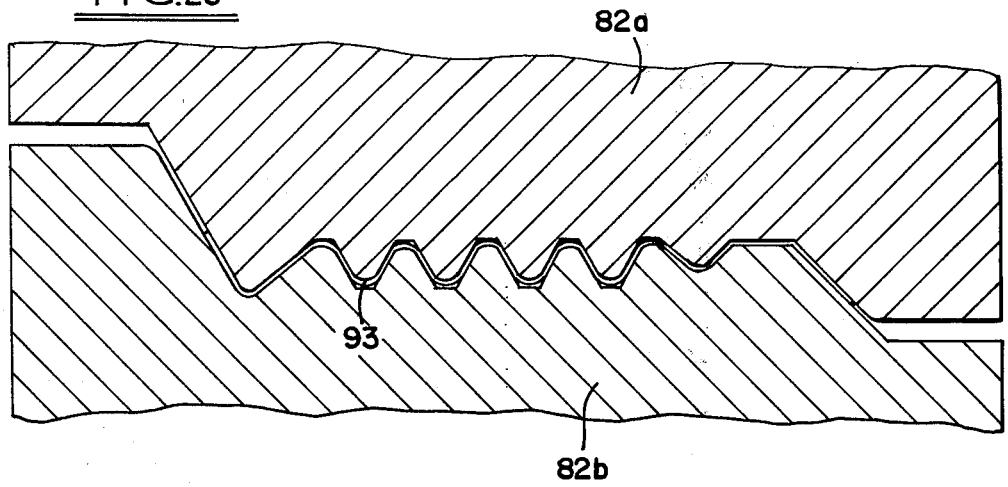
FIG. 26 is a fragmentary cross-sectional view of the third die roller pair taken about line 26—26 in FIG. 8.
Figure 27:
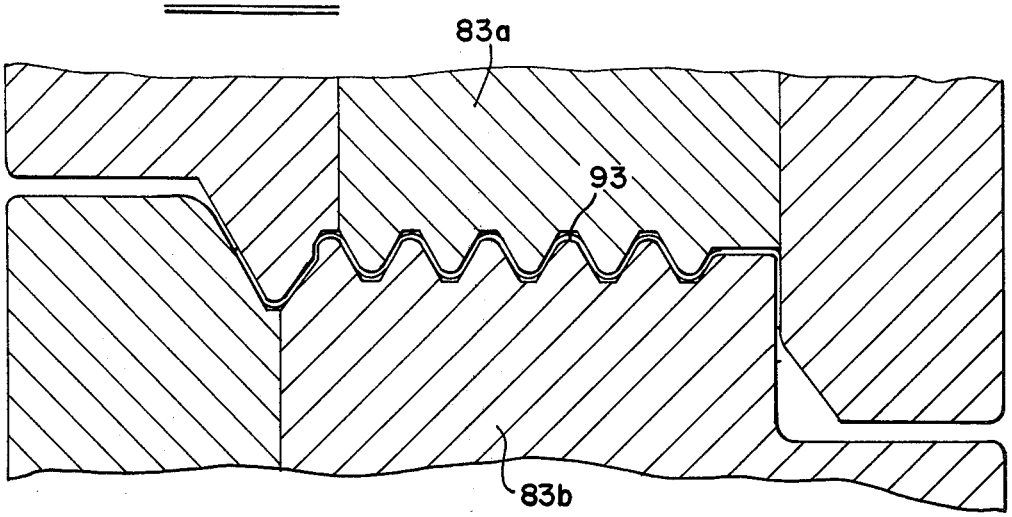
FIG. 27 is a fragmentary cross-sectional view of the fourth die roller pair taken about line 27—27 in FIG. 8.

A run-out table 130 is best illustrated in FIGS. 17 and 19. The purpose of the run-out table is to provide support for the tubing after the length of tubing extends beyond the support rollers 126 and 127. Tubular supports 131 and 132 provide this support. Tubes 133 and 134 form a support structure for support tubes 131 and 132 by means of brackets 135*a*, 135*b* and 135*c*. The tubing utilized was fabricated from light weight aluminum which provided strength and a low friction surface for support tubes 131 and 132 to minimize friction with the spiraling tubing. Tubes 133 and 134 are mounted to bracket 136, which is pivotally mounted to brackets 137*a* and 137*b*. This method of mounting permits the run-out table to be pivoted parallel and adjacent to cover 41 for storage. This permits this apparatus to be stored in a minimum of space when not in operation. The space consumed for storage is further reduced since support tubing 131, 132 and 133 have extension tubes 131*a*, 132*a* and 133*a* respectively which extend the length of the run-out table. The extension tubes each have reduced diameter portions which fit within tubes 131, 132 and 133 respectively providing easy disassembly for storage.

A switch enclosure 138 is adjustably mounted to either tubing 133 or 133*a*. This housing contains a limit switch which is operated by movement of extended handle 138*a*. Handle 138*a* extends slightly above the top surface of support tubing 131 and 132 to make contact with the leading edge of the corrugated tubing. This switch is connected to electrical control box 46 to automatically stop electrical motor 49 when a desired length of tubing has been manufactured.

Fig. 23 illustrates corrugated tubing which is produced by the instant apparatus having strip end 140 at the end of the length of tubing.

FIG. 21 illustrates the general engagement of the side edges of aluminum stripping 93. This engagement is deformed thereby making a seam 141.

FIG. 22 illustrates the engaged side edges (inside and outside seam elements) of stripping 93 after the seam has been "locked", that is deformed to prevent the edges from separating but allowing arcuate movement.

The following is an explanation of the stripping's convolution. Aluminum strip 93 is fed from the die roller pairs through rectangular guide 45 where the outside side edge is further shaped by dies 94. Next, the corrugated strip is fed between stabilizing rollers 95 which act to impart an initial curvature to the strip and to stabilize the strip at the bottom circumference of the tubing. Conical surface 95*c* of roller 95*b* in conjunction with the mating surface of roller 95*a* compresses outside edge portion 93*a* and 93*b* toward a flattened condition.

The strip is then fed between curling rollers 98 which perform several functions. As previously described, the curling rollers impart the proper radius of curvature and helical angle to the corrugated aluminum strip. End roller portions 98*c* and 98*d* of rollers 98*a* and 98*b* respectively mate to compress and deform the common seam with corrugations. FIG. 22 illustrates the common seam locked with corrugations made by roller portions 98*c* and 98*b*.

The corrugated strip is guided during its spiral by guide rollers 116*a*, 116*b* and 116*c* by each's periphery closest to stabilizing rollers 95.

As the strip spirals clockwise beyond guide roller 116*c*, the convolution is almost completed. As the strip approaches dies 94, the inside seam element consisting of portions 93*d* and 93*c* engage the outside side element 93*a* and 93*b*. Dies 94 provide the first forming of that engagement. The strip continues to convolute entering stabilizing rollers 95 with the seam being compressed towards a flattened condition by conical portion 95*c* and corresponding section of roller 95*a*. This common seam is "locked" together by roller portions 98*c* and 98*d* by being deformed with corrugations. This continuous process of convoluting and seaming continues until the desired length of corrugating tubing have been manufactured.

From the preceding description of preferred embodiment, several improvements in manufacturing corrugating aluminum tubing are apparent. Curling rollers 98 not only impart the proper radius of curvature and helical angle but are positioned by a single adjustment. None of the rollers nor guides used in the coiling head 44 are power driven. No additional parts are required to produce different diameter tubing over the specified range. The eccentric mounting of each of the upper die forming rollers makes them easily adjustable. The spool of strip material is self-contained within the apparatus enclosure, thereby preventing damage to the material and providing a self-contained storing space. A pivoting front wheel 32 allows the unit to be easily moved and to be stabilized during tubing manufacture. A braking mechanism stops rotation of the spool when the motor is stopped.

Other modifications and embodiments of the instant apparatus may be made by those skilled in the art without departing from the scope of the subject matter disclosed herein. Materials other than light gauge aluminum, of course, could be utilized to fabricate circular tubing with or without corrugations. Rotation of the coiling head plate could also be incorporated into a single adjustment whereby the proper radius of curvature, helical angle, and coiling plate angle are simultaneously set by a single adjustment. Adjustment of the support rollers could also be incorporated into a single adjustment. A range beyond 13 inches can be obtained by increasing the depth of corrugations and with appropriate changes to the coiling head.

Because the seam allows the engaged edges of the strip to turn with respect to each other, strip 140 terminating the end of a length of tubing as illustrated in FIG. 23 can be axially rotated. This rotation will cause the end of the tubing to spiral inward decreasing the diameter or spiral outward increasing the diameter depending upon the direction of rotation. This ability is utilized to join lengths of tubing having the same diameter. It would also be used to join tubing of different diameters or to join tubing with a stationary vent.

The end of a length of tubing which has its diameter increased can be reduced in diameter to captivate another length inserted into it. An end may have its diameter reduced, be inserted into another length, and have its diameter increased thereby being captivated by the other length. Two ends of tubing to be joined can have one end reduced and the other increased and have each end then returned to near its original diameter after inserting the smaller into the larger. Thus, both lengths captivate each other. This latter example provides the smoothest transition from one length to the next length. If desired, sealant can be applied to the mating surfaces to improve the joint's seal. The sealant may make permanent bonding or serve as calking.

Although the instant invention has been illustrated and described in some detail, the description and illustrations are offered merely as an example of the instant invention. The instant invention is limited in scope only by the appended claims.

We claim:

1. An improved apparatus for forming corrugated tubes of selectable diameter from ductile stip material including a frame, a means attached to said frame for making longitudinal corrugations in said strip material, a motor driving said corrugation making means, a means carried by said frame for forming the side edges of the strip material into inside and outside seam elements, a means carried by said frame for imparting a radius of curvature for the selected diameter of tubing to the strip material after corrugation, a means carried by the frame for imparting a helical angle to the strip material such that the inside seam element engages the outside seam element upon convolution of the strip, means for guiding the periphery of the strip during convolution, and a means for locking the engagement of the inside seam element with the outside seam element, said locking means deforming said engagement; the improvement comprising:

a means for simultaneously adjusting the means for imparting radius of curvature and the means for imparting helical angle so that the radius of curvature and helical angle required for the selected tubing diameter is produced.

2. The apparatus according to claim 1 wherein said means for imparting radius of curvature comprises a pair of curling rollers between which the corrugated strip passes, said rollers having a constant spaced relationship with respect to each other, said curling pair of rollers being moveable by said adjusting means with respect to the axis of the tubing.

3. The apparatus according to claim 2 wherein said helical imparting means comprises said pair of curling rollers which is pivotably mounted, the axis of each of said rollers remains parallel with respect to each other, said pair of curling rollers is pivoted by said adjusting means to impart the proper helical angle to the corrugated strip for the diameter of tubing selected.

4. The apparatus according to claim 3 wherein said adjusting means comprises a rotatable shaft which carries said pair of curling rollers, a cam follower attached to said rotatable shaft for controlling the rotation of said shaft, a path along which said cam follower rides, and a means for mounting said rotatable shaft to provide lateral movement of said shaft, whereby said pair of curling rollers are moveable with respect to the axis of the tubing to impart the proper radius of curvature, said curling rollers pivoted by rotation of said shaft as controlled by the cam following said path to impart the proper helical angle for the desired diameter of tubing.

5. The apparatus according to claim 1 further comprising a means for pivoting said guiding means to maintain said guiding means tangential to the periphery of the strip during convolution for different tubing diameter.

6. An improved apparatus for forming corrugated tubes of selectable diameter from ductile strip material, said strip material being wound on spools, the apparatus including a frame, an enclosure encompassing a substantial portion of the frame, a means attached to said frame for making longitudinal corrugations in said strip material, a motor driving said corrugation making means, a means carried by said frame for forming the side edges of the strip material into inside and outside seam elements, a means carried by said frame for imparting a radius of curvature to the strip material after corrugation to form the selected diameter of tubing, a means carried by the frame for imparting a helical angle to the strip material such that the inside seam element engages the outside seam element upon convolution of the strip, means for guiding the periphery of the strip during convolution, and a means for locking the engagement of the inside seam element with the outside seam element, said locking means deforming said engagement; the improvement comprising:

a means for rotatably mounting said spool of strip material within said enclosure; and a brake means separate from said spool for stopping the rotation of the spool when the motor ceases driving the corrugation making means, thereby preventing any significant uncoiling of the strip material due to the spool's inertia.

7. The apparatus according to claim 6 further comprising a means for adjusting the means for imparting radius of curvature and the means for imparting helical angle.

8. The apparatus according to claim 6 further comprising a spool loading means comprised of a ramp, a support means pivotally carried by the frame for supporting the spool of strip material at its circumference, a threaded stud mounted perpendicular to said frame adjacent said support means, and a lifting means threadedly mounted to said stud, whereby the spool is loaded by rolling it up the ramp onto the support means which lifts the spool as the support means is pivoted upward by said lifting means, screwing said lifting means inward along the threaded stud causes the support means to pivot upward.

9. The apparatus according to claim 1 or 6 wherein said means for locking the engagement of the inside seam element with the outside seam element comprises a pair of mating rollers having irregular circumferencial surfaces which operate to deform said engagement, said engagement being squeezed between said mating rollers.

10. The apparatus according to claim 1 or 6 wherein said corrugation making means comprises a plurality of pairs of die-forming rollers, one die roller of each pair having a rotable eccentric mounting which allows adjustment of the spacing between rollers.

11. The apparatus according to claim 1 or 6 further comprising a pair of adjustable support rollers which support the corrugated tubing after convolution.

12. The apparatus according to claim 1 or 6 further comprising a run-out table to support the corrugated tubing, said table being pivotably mounted to said frame allowing it to be pivoted substantially parallel and adjacent to the apparatus enclosure when not in use.

13. The apparatus according to claim 1 or 6 wherein said frame is mounted on wheels, one of said wheels and a handle are mounted to a bracket which is pivotally mounted to said frame, whereby the frame adjacent to said bracket rests upon the floor when the handle is in a substantially vertical position, when the handle is in a substantially horizontal position said one wheel pivots downwardly lifting the frame clear of the floor for rolling movement.

14. The apparatus according to claim 7 wherein said adjusting means simultaneously adjusts the means for imparting radius of curvature and the means for imparting helical angle.

15. An improved apparatus for forming corrugated tubes of selectable diameter from ductile strip material, said strip material being wound on spools, the apparatus including a frame, an enclosure encompassing a substantial portion of the frame, a means attached to said frame for making longitudinal corrugations in said strip material, a motor driving said corrugation making means, a means carried by said frame for forming the side edges of the strip material into inside and outside seam elements, a means carried by said frame for imparting a radius of curvature to the strip material after corrugation to form the selected diameter of tubing, a means carried by the frame for imparting a helical angle to the strip material such that the inside seam element engages the outside seam element upon convolution of the strip, means for guiding the periphery of the strip during convolution, and a means for locking the engagement of the inside seam element with the outside seam element, said locking means deforming said engagement; the improvement comprising:

a spool loading means comprises of a ramp, a support means pivotally carried by the frame for supporting the spool of strip material at its circumference, a threaded stud mounted perpendicular to said frame adjacent said support means, and a lifting means threadedly mounted to said stud, whreby the spool is loaded by rolling it up the ramp onto the support means which lifts the spool as the support means is pivoted upward by said lifting means, screwing said lifting means inward along the threaded stud causes the support means to pivot upward.

16. An improved apparatus for forming corrugated tubes of selectable diameter from ductile strip material including a frame, a means attached to said frame for making longitudinal corrugations in said strip material, a motor driving said corrugation making means, a means carried by said frame for forming the side edges of the strip material into inside and outside seam elements, a means carried by said frame for imparting a radius of curvature for the selected diameter of tubing to the strip material after corrugation, a means carried by the frame for imparting a helical angle to the strip material such that the inside seam element engages the outside seam element upon convolution of the strip, means for guiding the periphery of the strip during convolution, and a means for locking the engagement of the inside seam element with the outside seam element, said locking means deforming said engagement; the improvement comprising:

said frame is mounted on wheels, one of said wheels and a handle are mounted to a bracket which is pivotally mounted to said frame, whereby the frame adjacent to said bracket rests upon the floor when the handle is in a substantially vertical position, when the handle is in a substantially horizontal position said one wheel pivots downwardly lifting the frame clear of the floor for rolling movement.

* * * * *